US006802700B2

(12) United States Patent
Shin

(10) Patent No.: US 6,802,700 B2
(45) Date of Patent: Oct. 12, 2004

(54) OIL SUPPLYING APPARATUS FOR OPPOSED TYPE RECIPROCATING COMPRESSOR

(75) Inventor: Dong-Koo Shin, Anyang (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/241,769

(22) Filed: Sep. 12, 2002

(65) Prior Publication Data

US 2003/0077192 A1 Apr. 24, 2003

(30) Foreign Application Priority Data

Oct. 23, 2001 (KR) ..... 2001-65452

(51) Int. Cl.[7] ..... F04B 19/00; F04B 17/00; F04B 17/04; F01M 1/00

(52) U.S. Cl. ..... 417/488; 417/415; 417/416; 184/6.8; 184/13.1

(58) Field of Search ..... 417/313, 415, 417/416, 417, 418, 419, 486, 487, 488; 184/6.8, 6.26, 11.1, 11.2, 13.1

(56) References Cited

U.S. PATENT DOCUMENTS 1,096,790 A * 5/1914 Miles ..... 74/570
1,231,900 A * 7/1917 Jones ..... 403/39
1,766,829 A * 6/1930 Myers ..... 92/153
5,693,991 A * 12/1997 Hiterer et al. ..... 310/30
5,993,175 A * 11/1999 Kim et al. ..... 417/417
6,024,544 A * 2/2000 Kim et al. ..... 417/417
6,089,352 A * 7/2000 Kim et al. ..... 184/6.16

FOREIGN PATENT DOCUMENTS

JP 08-284832 * 10/1996 ..... F04B/39/02
WO WO 00/17585 * 3/2000 ..... F25B/1/02

* cited by examiner

*Primary Examiner*—Justine R. Yu
*Assistant Examiner*—Timothy P. Solak
(74) *Attorney, Agent, or Firm*—Birch, Stewart, Kolasch & Birch, LLP

(57) ABSTRACT

An oil supplying apparatus for an opposed type reciprocating compressor comprises oil kickers which are mounted on spring supporting plates coupled to armatures of respective reciprocating motors, or oil valves which are mounted on oil paths formed on a cylinder and coonnecting with a suction path, and thereby, oil in a casing can be supplied to a slant portion between the cylinder and pistons regardless of the installation type of the compressor. In addition, lack of oil in the compressor and friction caused by the lack of oil can be prevented in advance, and a reliability of the compressor can be improved.

21 Claims, 6 Drawing Sheets

OIL SUPPLYING APPARATUS FOR OPPOSED TYPE RECIPROCATING COMPRESSOR

BACKGROUND OF THE INVENTION

1. Field of the Invention

The present invention relates to an oil supplying apparatus for an opposed type reciprocating compressor, and particularly, to an oil supplying apparatus for an type opposed reciprocating compressor which is able to supply the oil smoothly when a compressor is installed in lying or in standing type.

2. Description of the Background Art

Generally, an opposed type reciprocating compressor is a compressor of high efficiency and low vibration in which two compression units coupled respective reciprocating motors are disposed to face each other in one casing.

As shown in FIG. 1, the conventional opposed type reciprocating compressor comprises a casing 10 including a plurality of suction pipes (SP1 and SP2) and a discharge pipe (DP), a first reciprocating motor 21 and a second reciprocating motor 22 mounted on inner both sides of the casing 10, a cylinder 30 disposed between the reciprocating motors 21 and 22, a first piston 41 and a second piston 42 inserted into the cylinder 30 to be slided and coupled to armatures 21C and 22C of the reciprocating motors 21 and 22 to form a compression space S, a first suction valve 51 and a second suction valve 52 mounted on a front end surfaces of the pistons 41 and 42, a discharge valve 60 mounted on the compression space S between the pistons 41 and 42 so as to be opened/closed, and a first spring assembly 71 and a second spring assembly 72 for supporting the armatures 21C and 22C of the reciprocating motors 21 and 22 and for supporting the respective pistons 41 and 42 in order to induce resonating movements.

The reciprocating motors 21 and 22 respectively comprise outer stators 21A and 22A and inner stators 21B and 22B formed as cylindrical shapes and fixed on the casing 10, and armatures 21C and 22C disposed between the outer stators 21A and 22A and the inner stators 21B and 22B for performing linear reciprocating movements.

The cylinder 30 is formed as a cylinder including a through hole 31 in a direction of reciprocating movement of the pistons 41 and 42 so that the pistons 41 and 42 are inserted as sliding therethrough to form the compression space S, and an outer circumferential surface of the cylinder 30 is adhered to an intermediate part of an inner circumferential surface of the casing 10 and fixed.

Also, on center part of the through hole 31 on the cylinder 30, a discharge hole 32 which is communicated with the compression space S to penetrate in radial direction of the cylinder 30 is formed.

The first piston 41 and the second piston 42 are respectively coupled to the armatures 21C and 22C of the first and second reciprocating motors 21 and 22, and suction flow paths 41*a* and 42*a* are penetratingly formed on hollow portions of the respective pistons 41 and 42 in the direction of reciprocating movement.

The first and second suction valves 51 and 52 are mounted on a front end surface of the respective pistons 41 and 42 so as to open/close the front ends of the suction flow paths 41*a* and 42*a* formed on the hollow portions of the respective pistons 41 and 42.

The discharge valve 60 is received inside the discharge hole 32 of the cylinder 30 so as to open/close the discharge hole 32.

The first and second spring assemblies 71 and 72 respectively comprise a first spring supporting plate 71A and a second spring supporting plate 72A coupled to the armatures 21C and 22C of the respective reciprocating motors 21 and 22 and to the pistons 41 and 42, and a plurality of resonating springs 71B and 72B for supporting both side surfaces of the respective spring supporting plates 71A and 72A.

Hereinafter, operations of the conventional reciprocating compressor will be described.

When an electric source is applied to the reciprocating motors 21 and 22 which are located on both inner side surfaces of the casing 10, the respective pistons 41 and 42 perform reciprocating movements toward opposite directions of each other inside the cylinder 30, and at the same time, refrigerant gas is sucked into the casing 10 through the suction pipes SP1 and SP2. After that, the refrigerant gas is induced into the compression space S of the cylinder 30 and compressed by the continuous reciprocating movements of the pistons 41 and 42, and discharged to the outer system of the casing 10 through the discharge pipe DP. And the above processes are repeated.

However, in the conventional opposed type reciprocating compressor, the refrigerant gas which is induced into the casing 10 through the suction pipes SP1 and SP2 is mixed with the oil filled in the casing 10, and induced into the compression space S to supply the oil as sliding into the cylinder 30 and to a sliding portion between the pistons 41 and 42. However, the mixture of the sucked gas and the oil is not made smoothly and the amount of supplied oil is not sufficient. Even if the oil is supplied, the speed of supplying oil is reduced, and therefore, a dry abrasion between the cylinder 30 and the pistons 41 and 42 may be caused due to lack of oil during operation of compressor.

SUMMARY OF THE INVENTION

Therefore, an object of the present invention is to provide an oil supplying apparatus for an opposed type reciprocating compressor which is able to supply oil between a cylinder and a piston smoothly.

To achieve the object of the present invention, as embodied and broadly described herein, there is provided an oil supplying apparatus for an opposed type reciprocating compressor comprising: a casing having a suction pipe and a discharge pipe on both sides thereof to be communicated and having a predetermined amount of oil filled therein; a plurality of reciprocating motors installed on inner both sides of the casing to perform reciprocating movements toward opposite directions of each other; a cylinder having a compression space mounted between the reciprocating motors; a plurality of pistons respectively coupled to armatures of the reciprocating motors and inserted as sliding into the cylinder so that front end surfaces thereof face each other; a discharge valve assembly and a suction valve assembly for opening/closing a suction side and a discharge side of the compression space alternately so that the compression space of the cylinder can be communicated with the suction pipe and the discharge pipe alternately; spring supporting plates coupled to the armatures of the reciprocating motors; and oil kickers coupled to outer circumferential surfaces of the spring supporting plates for kicking the oil filled inside the casing during the reciprocating movements.

Also, to achieve the object of the present invention, there is provided an oil supplying apparatus for an opposed type reciprocating compressor comprising: a casing having a suction pipe and a discharge pipe which are communicated with each other on both sides thereof and having a predetermined amount of oil filled therein; a plurality of reciprocating motors installed on inner both sides of the casing to perform linear reciprocating movements toward opposite directions of each other; a cylinder including a compression space mounted between the reciprocating motors; a plurality of pistons coupled to armatures of the reciprocating motors and inserted as sliding into the cylinder so that front end surfaces thereof face each other; a discharge valve assembly and a suction valve assembly for opening/closing a suction side and a discharge side of the compression space alternately so that the compression space of the cylinder are communicated with the suction pipe and the discharge pipe alternately; and oil valves mounted on center portions of an oil paths, which are formed on inner cross section of the cylinder, for controlling flow of the oil.

Also, to achieve the object of the present invention, there is provided an oil supplying apparatus for an opposed type reciprocating compressor comprising: a casing having a suction pipe and a discharge pipe which are communicated with each other on both sides thereof and having a predetermined amount of oil filled therein; a plurality of reciprocating motors installed on inner both sides of the casing to perform linear reciprocating movements toward opposite directions of each other; a cylinder, including a suction path communicating with the suction pipe and a discharge path communicating with the discharge pipe, a compression space between the suction path and the discharge path, and an oil path communicating with the compression space, mounted between the reciprocating motors; a plurality of pistons coupled to armatures of the reciprocating motors and inserted as sliding into the cylinder so that front end surfaces thereof face each other; a discharge valve assembly and a suction valve assembly for opening/closing a suction side and a discharge side of the compression space alternately so that the compression space of the cylinder are communicated with the suction pipe and the discharge pipe alternately; spring supporting plates coupled to the armatures of the reciprocating motors; oil kickers coupled to outer circumferential surfaces of the spring supporting plates for kicking the oil filled inside the casing during the reciprocating movements; and oil valves mounted on center portions of the oil paths, which are formed on an inner cross section of the cylinder, for controlling flow of the oil.

The foregoing and other objects, features, aspects and advantages of the present invention will become more apparent from the following detailed description of the present invention when taken in conjunction with the accompanying kickings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
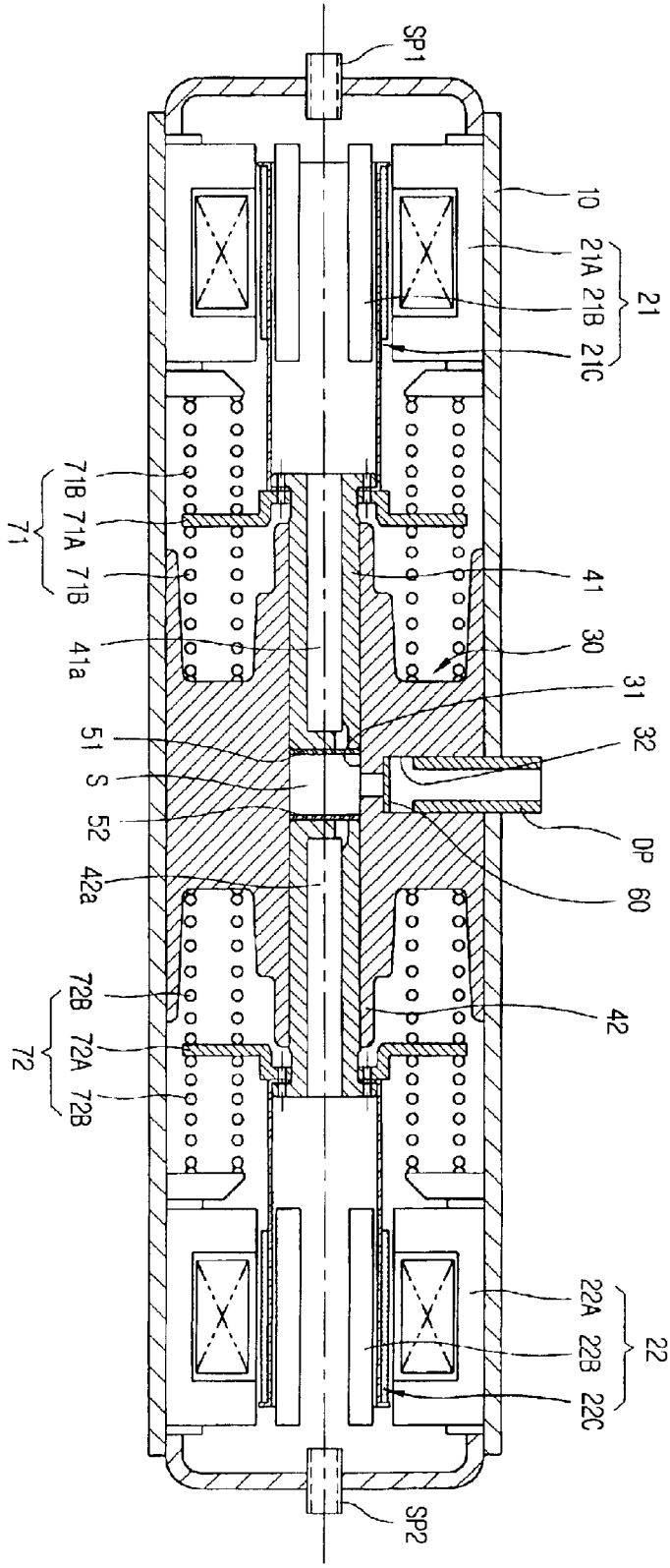
FIG. 1 CONVENTIONAL ART
FIG. 1 is a longitudinal cross-sectional view showing an example of a conventional opposed type reciprocating compressor.
Figure 2:
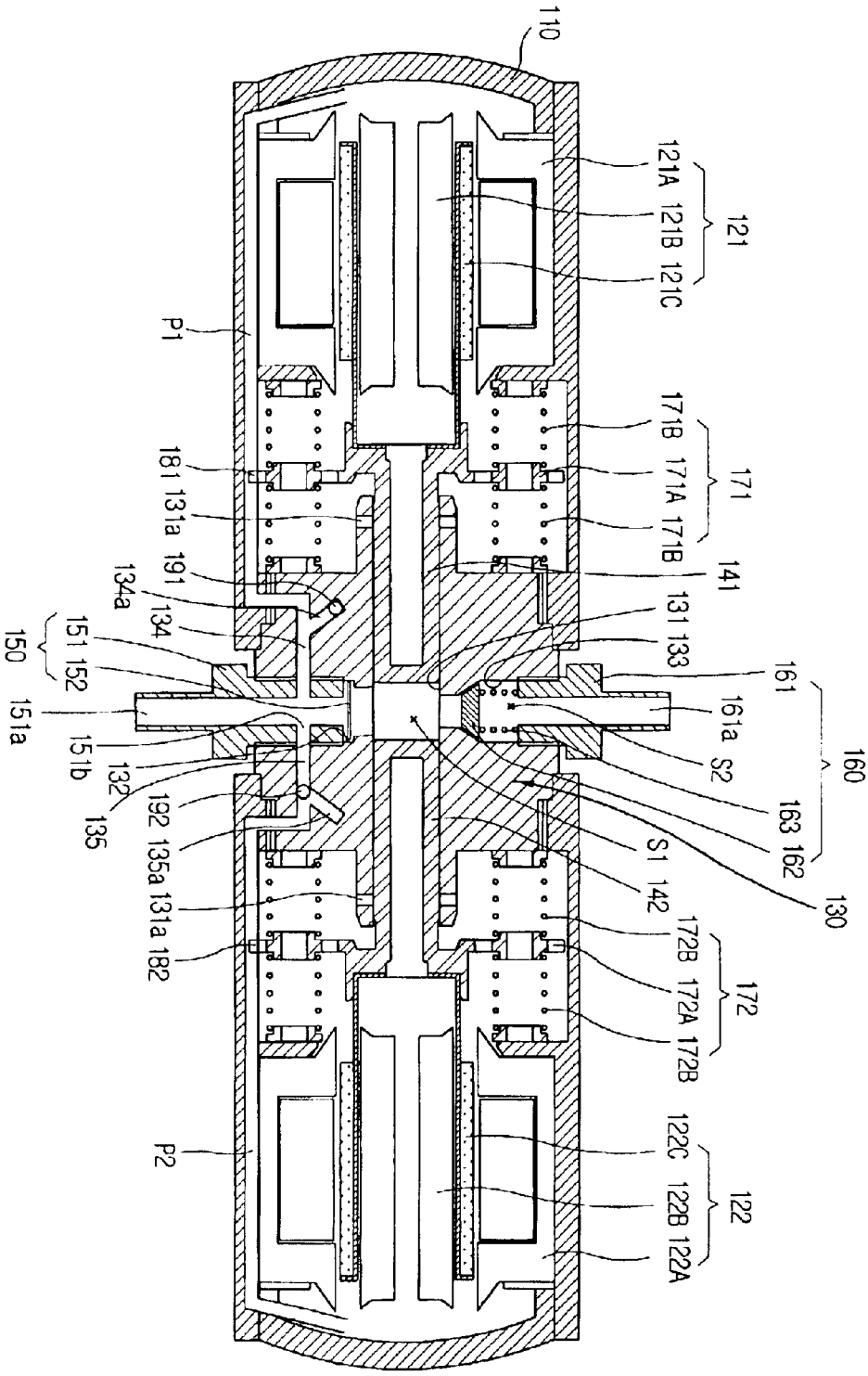
FIG. 2 is a longitudinal cross-sectional view showing an example of an opposed type reciprocating compressor according to the present invention.
Figure 3:
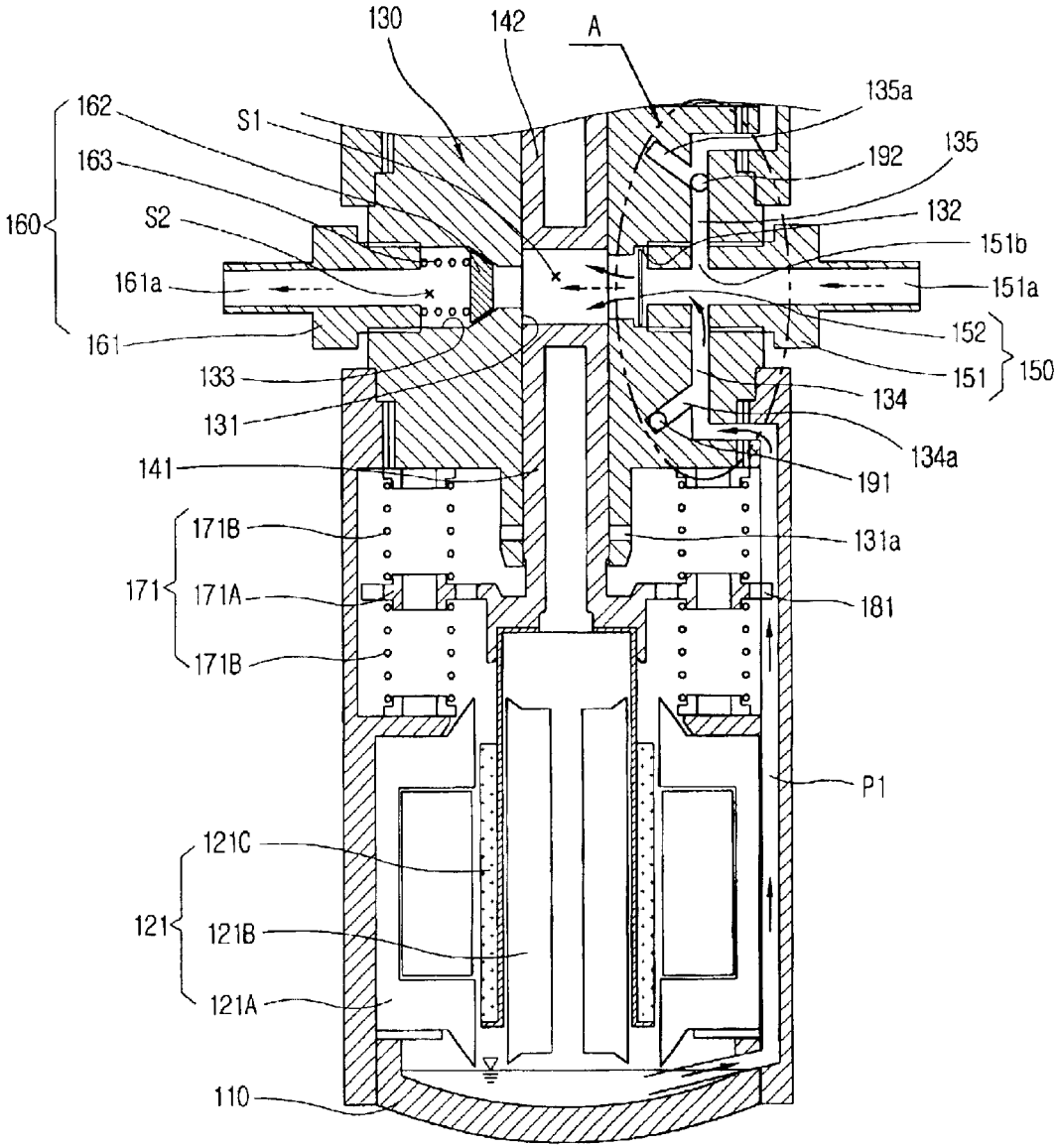
FIG. 3 is a half cross-sectional view showing a process of supplying oil when the opposed type reciprocating compressor according to the present invention is installed as a standing type.
Figure 4:
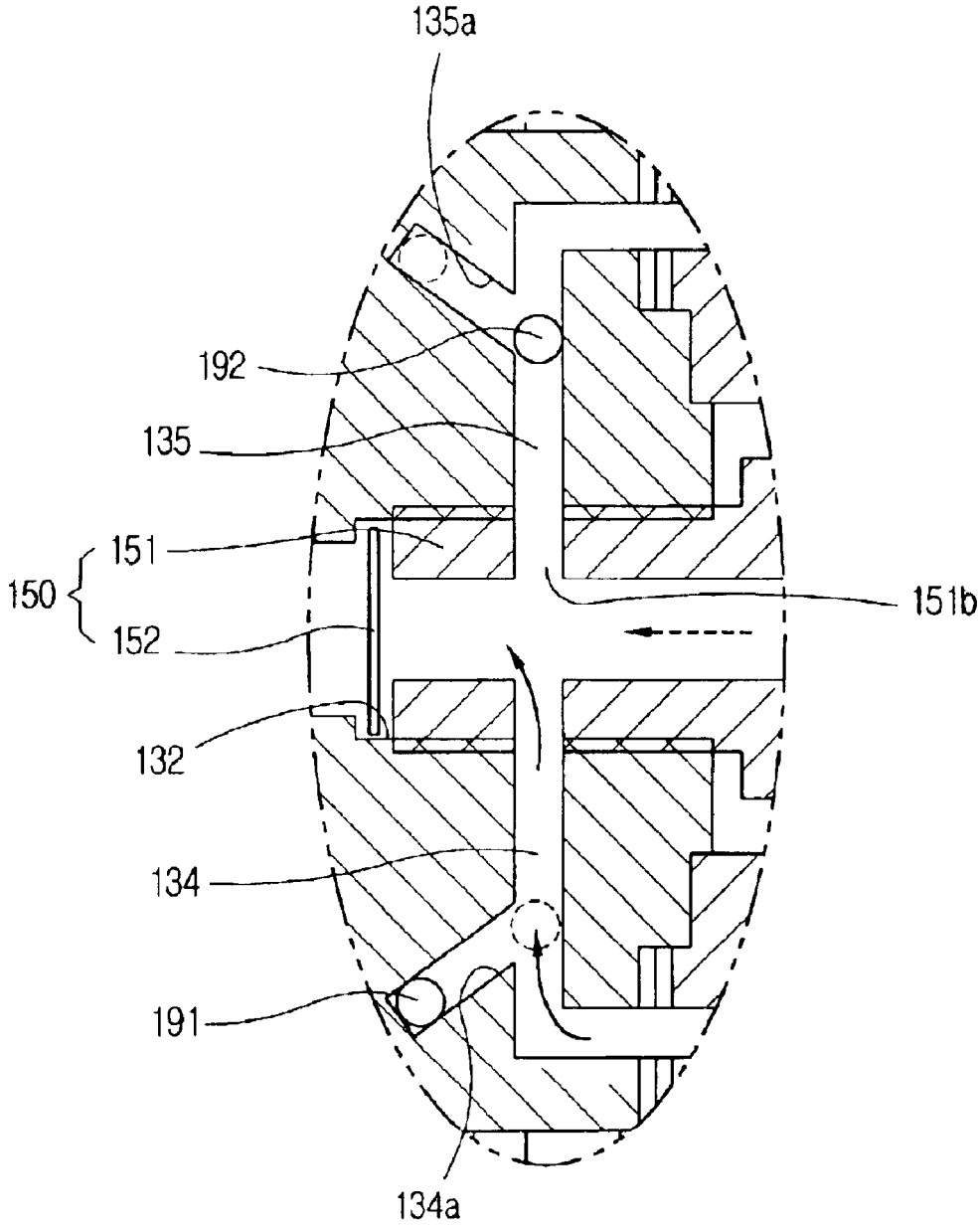
FIG. 4 is a sketch showing "A" part in FIG. 3.
Figure 5:
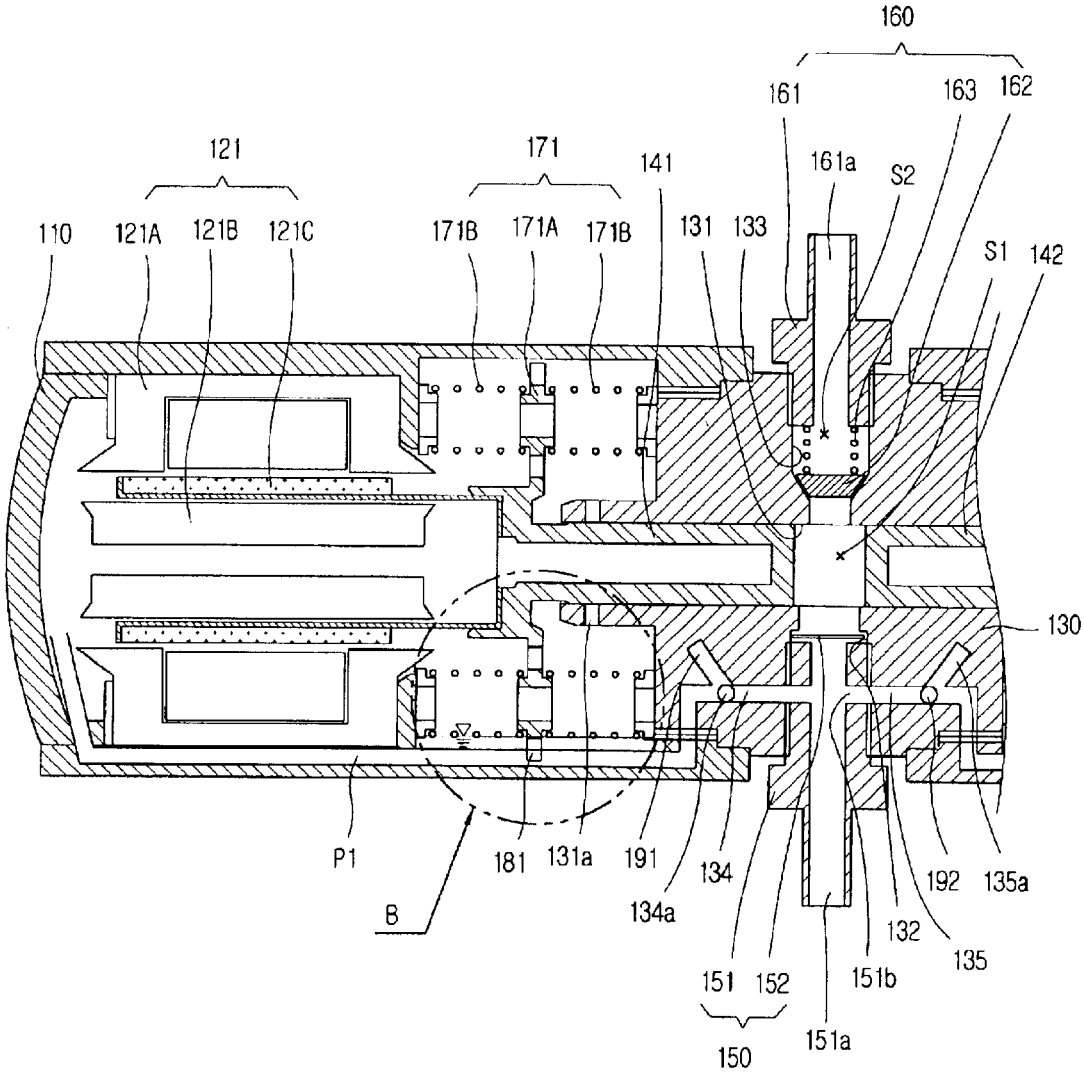
FIG. 5 is a half cross-sectional view showing a process of supplying oil when the opposed type reciprocating compressor according to the present invention is installed as a lying type.
Figure 6:
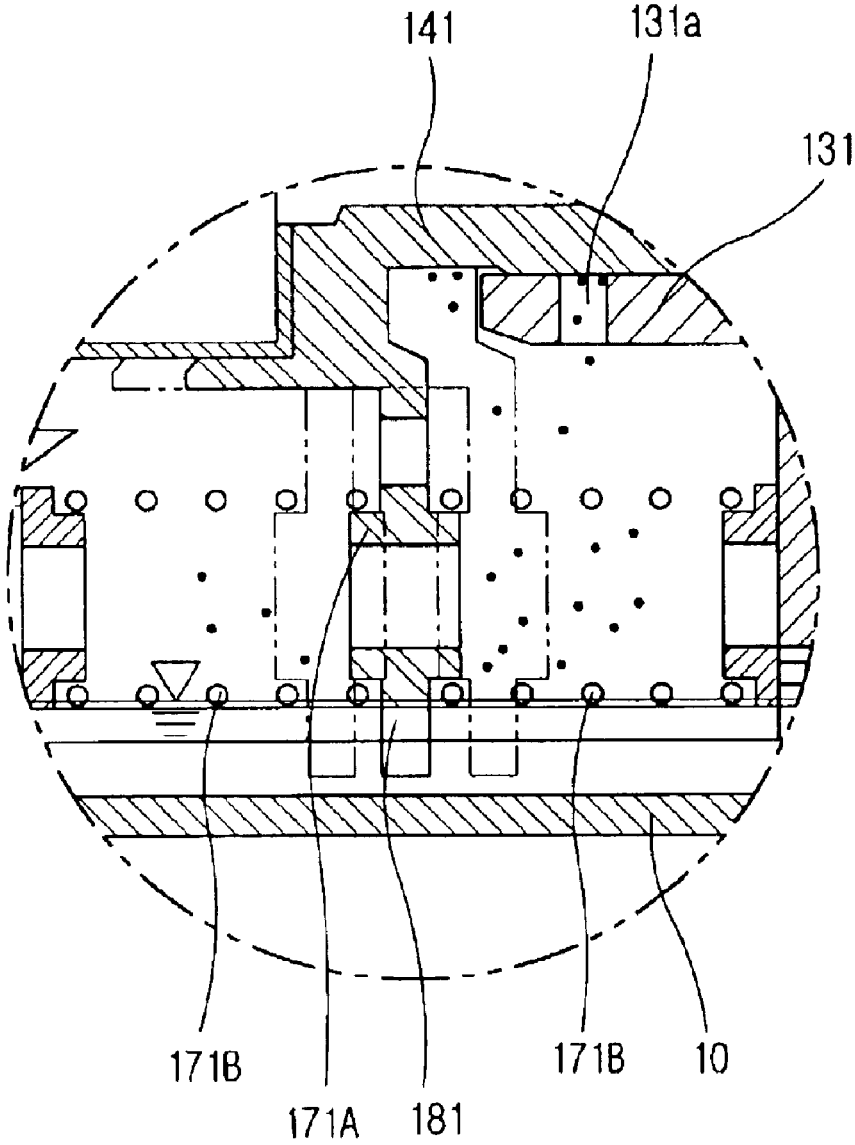
FIG. 6 is a sketch showing "B" part in FIG. 5.

FIG. 2 is a longitudinal cross-sectional view showing an example of opposed type reciprocating compressor according to the present invention, FIG. 3 is a half cross-sectional view showing a process of supplying oil when the opposed type reciprocating compressor according to the present invention is installed as a standing type, FIG. 4 is a sketch showing "A" part in FIG. 3, FIG. 5 is a half cross-sectional view showing a process of supplying oil when the opposed type reciprocating compressor according to the present invention is installed as a lying type, and FIG. 6 is a sketch showing "B" part in FIG. 5.

As shown in FIG. 2, the opposed type reciprocating compressor according to the present invention comprises: a casing 110 including a suction pipe (not shown) and a discharge pipe (not shown) installed to be communicated, and a predetermined amount of oil filled therein; a first reciprocating motor 121 and a second reciprocating motor 122 installed on inner both sides of the casing 110 for generating linear reciprocating movements in opposite directions of each other; a cylinder 130 installed between the reciprocating motors 121 and 122; a first piston 141 and a second piston 142 coupled to armatures 121C and 122C of the reciprocating motors 121 and 122 and inserted as sliding into the cylinder 130 so that front end surfaces thereof face each other; a suction valve assembly 150 and a discharge valve assembly 160 respectively mounted on a suction path 132 and a discharge path 133 of the cylinder 130; a first spring assembly 171 and a second spring assembly 172 elastically supporting the armatures 121C and 122C of the reciprocating motors 121 and 122 and the pistons 141 and 142 to induce resonating movements; a first oil kicker 181 and a second oil kicker 182 coupled to the respective armatures 121C and 122C of the reciprocating motors 121 and 122 for kicking the oil filled in the casing 110 during reciprocating movements; and a first oil valve 191 and a second oil valve 192 mounted on center parts of respective oil paths 134 and 135 of the cylinder 130 to control the flow of the oil.

The cylinder 130 may be formed integrally so that an outer circumferential surface thereof can be adhered to an inner circumferential surface of the casing 110, or may be fabricated separately and fixed on the inner circumferential surface of center portion of casing 110.

Also, the cylinder 130 includes a through hole 131 in the direction of reciprocating movements of the pistons 141 and 142 so that the pistons 141 and 142 are inserted sliding into the cylinder to form a compression space S1, a suction path 132 formed so that the compression space S1 and the suction pipe (not shown) are communicated with each other, and a discharge path 133 formed so that the compression space S1 and the discharge pipe (not shown) are communicated with each other.

In addition, it is desirable that the suction path 132 and the discharge path 133 are formed to have phase difference of 180° with each other so that inner ends of these two face each other on a straight line.

Also, the compression space S1 is formed between the suction path 132 and the discharge path 133, the first oil path 134 and the second oil path 135 are formed on both sides of the cylinder so as to communicate with the compression space S1 through the suction path 132, and a first oil valve escape recess 134*a* and a second oil valve escape recess 135*a* are formed as slanted in symmetric directions with each other on center part of the respective oil paths 134 and 135.

In addition, it is desirable that the slanted directions of the oil valve escape recesses 134 and 135 are formed symmetrically to form V-shape so as to face outer side for axial lines of the suction path 132 and the discharge path 133.

And oil guiding pipes P1 and P2 of which ends are soaked in the oil are mounted on starting ends of the first and second oil paths 134 and 135 so as to guide the oil which is filled in the casing 110 to the respective oil paths 134 and 135.

Also, at least two oil holes 131*a* or more for inducing and recalling the oil are formed on both sides of the cylinder 130.

The suction valve assembly 150 comprises a suction adapter 151 which includes a gas through opening 151*a* communicating with the suction pipe (not shown) and is press-fitted into the suction path 132 of the cylinder 130, and a suction valve 152 for opening/closing the gas through opening 151*a* by adhering/separating to/from a front end surface of the suction adapter 151.

In addition, a diameter of the gas through opening 151*a* of the suction adapter 151 is formed to be shorter than an inner diameter of the suction path 132, and oil through openings 151*b* are formed on both sides of the gas through-opening 151*a* so as to be communicated with the oil paths 134 and 135.

The suction valve 152 is formed as a round plate including a few through-holes (not shown) on an outer circumferential surface thereof, and it is desirable that a diameter which links inner circumferential surfaces of the through holes is larger than the diameter of the gas through opening 151*a*, and smaller than inner end diameter of the suction path 132.

In addition, the discharge valve assembly 160 comprises a discharge adapter 161 including a gas through opening 161*a* so as to communicate with the discharge pipe (not shown) and press-fitted into the discharge path 133 of the cylinder, a discharge valve 162 for opening/closing the inner end of the discharge path 133 by being elastically supported on the front end surface of the discharge adapter 161, and a valve spring 163 mounted between a pressure back surface of the discharge valve 162 and the front end surface of the discharge adapter 161 for supporting the discharge valve 162.

In addition, the discharge adapter 161 is inserted as being apart from the inner end of the discharge path 133, and thereby a discharge space S2 for receiving the discharge valve 162 and the valve spring 163 is formed on inner side of the discharge path 133.

In addition, the discharge valve 162 is formed as a truncated cone comprising a pressure surface inserted into the discharge path 133, a pressure back surface which is larger than the discharge path 133, and a slanted sealing surface between the pressure surface and the pressure back surface. In addition, the corresponding inner end of the discharge path 133 includes a stepped surface, and a slanted sealing surface is formed on an edge of the stepped surface so as to surface contact to the sealing surface of the discharge valve 162.

On the other hand, the first spring assembly 171 and the second spring assembly 172 comprise a first spring supporting plate 171A and a second spring supporting plate 172A coupled to the armature 121C and 122C of the reciprocating motors 121 and 122 and to the pistons 141 and 142, and a few resonant springs 171B and 172B supporting both side surfaces of the respective spring supporting plates 171A and 172A.

Ends of the first and second spring supporting plates 171A and 172A are formed to be soaked in the oil filled inside the casing 110, and oil kickers 181 and 182 of ring shapes which kick the oil filled in the casing are coupled to the ends of the respective spring supporting plates 171A and 172A.

In addition, the first oil valve 191 and the second oil valve 192 are formed as spheres so as to open/close the respective oil paths 134 and 135 as being rolled between the respective oil paths 134 and 135 and the respective oil valve escape recesses 134*a* and 135*a* according to the installation type of the compressor.

Also, it is desirable that a diameter of oil valve escape recesses 134*a* and 135*a* is same with those of oil valves 191 and 192, and is larger than those of the oil paths 134 and 135.

Reference numerals 121A and 122A designate outer stators, and 121B and 122B designate inner stators.

Hereinafter, operation and effect of the oil supplying apparatus for the opposed type reciprocating compressor according to the present invention will be described.

When the electric power is applied to the first and second reciprocating motors 121 and 122, the first piston 131 and the second piston 132 perform linear reciprocating movements toward opposite directions of each other simultaneously in the through hole 131 of the cylinder 130. At the same time, the refrigerant gas is induced into the compression space S1 through the suction pipe (not shown), the gas through opening 151*a* of the suction adapter 151, and through the suction path 132 of the cylinder 130, compressed, and discharged to a system out of the casing 110 through the discharge path 133 of the cylinder 130, the gas through opening 161*a* of the discharge adapter 161, and through the discharge pipe (not shown).

Herein, as shown in FIG. 3, in case that the compressor is installed as a standing type, the oil in the casing 110 is lifted along with the oil guiding pipe P1 by a suction loss which is generated during the refrigerant gas is sucked through the suction pipe (not shown) and the gas through opening 151*a* of the suction adapter 151 in suction strokes of the respective pistons 141 and 142, and the oil is induced into the compression space S1 with the sucked gas through the oil path 134 of the cylinder and the oil through opening 151*b* of the suction adapter 151. In addition, some of the oil induced into the compression space S1 is soaked between the inner circumferential surface of the cylinder 130 and the corresponding first and second pistons 141 and 142 to lubricate the slant portion between the cylinder 130 and the pistons 141 and 142, and after that, the oil is dropped onto the bottom surface of the casing 110.

At that time, as shown in FIG. 4, the first oil valve 191 is rolled from the first oil path 134 down to the first oil valve escape recess 134*a* to open the first oil path 134, however, the second oil valve 192 blocks the second oil path 135 to increase suction pressure of the oil, and thereby, the oil filled on the bottom of the casing 110 can be smoothly induced into the compression space S1 along with the first oil guiding pipe P1.

On the other hand, as shown in FIGS. 5 and 6, in case that the compressor is installed as a lying type, the oil kickers 181 and 182 mounted on the respective spring supporting plates 171A and 172A strongly stir the oil on the bottom during the armatures 121C and 122C of the reciprocating motors 121 and 122 and pistons 141 and 142 perform the linear reciprocating movements. In addition, the stirred oil is spattered, and some of the oil is directly soaked into the slant portion of the adjacent cylinder 130 and pistons 141 and 142 or is recalled through the oil holes 131*a* of the cylinder 130 or through the slant portion.

As described above, the compressor of the present invention is able to supply the oil in the casing between the cylinder and pistons regardless of the installation type, that is, the standing type and the lying type. Thereby, lack of oil in the compressor and dried friction due to the lack of oil can be prevented in advance, and the reliability of the compressor can be improved.

According to the oil supplying apparatus for the opposed type reciprocating compressor of the present invention, the oil kickers are mounted on the spring supporting plates which are coupled to the armatures of respective reciprocating motors, or the oil valves are mounted on the oil paths, which are formed on the cylinder, communicating with the suction path, and thereby, the oil in the casing can be supplied to the slant portion between the cylinder and the pistons regardless of the installation type of the compressor. In addition, the lack of oil in the compressor and the dried friction caused by the lack of oil can be prevented in advance, and the reliability of the compressor can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An oil supplying apparatus for an opposed type reciprocating compressor comprising:

a casing having a suction inlet and a discharge outlet on sides thereof, said casing containing a predetermined amount of oil;

a plurality of reciprocating motors installed inside said casing to perform reciprocating movements toward opposite directions of each other;

a cylinder having a compression space said cylinder being located between the reciprocating motors;

a plurality of pistons respectively coupled to armatures of the reciprocating motors and inserted slidingly into the cylinder so that front end surfaces of said pistons face each other;

a discharge valve assembly and a suction valve assembly for opening/closing a suction side and a discharge side of the compression space alternately so that the compression space of the cylinder can be connected with the suction inlet and the discharge outlet alternately said discharge valve assembly and said suction valve assembly each directly facing a side portion of the compression space;

spring supporting plates coupled to the armatures of the reciprocating motors; and oil kickers coupled to outer circumferential surfaces of the spring supporting plates for kicking the oil inside the casing during the reciprocating movements.

2. The apparatus of claim 1, wherein the cylinder includes one or more oil holes for inducing and recalling the oil collecting respectively on both sides of a through-hole through which the pistons are inserted.

3. The apparatus of claim 1, wherein ends of the oil kickers coupled to the spring supporting plates are formed to be soaked in the oil inside the casing.

4. The apparatus of claim 3, wherein the oil kickers are formed as rings and mounted on ends of the spring supporting plates.

5. The apparatus of claim 1, wherein said suction inlet and said discharge outlet are located at substantially right angles with respect to a direction of said reciprocating movements of said reciprocating motors.

6. The apparatus of claim 1, wherein said suction valve assembly is located substantially opposite to said discharge valve assembly.

7. An oil supplying apparatus for an opposed type reciprocating compressor comprising:

a casing having a suction inlet and a discharge outlet on sides thereof, said casing containing a predetermined amount of oil;

a plurality of reciprocating motors installed inside said casing to perform linear reciprocating movements toward opposite directions of each other;

a cylinder including a compression space between the reciprocating motors;

a plurality of pistons coupled to armatures of the reciprocating motors and inserted slidingly into the cylinder so that front end surfaces thereof face each other;

a discharge valve assembly and a suction valve assembly for opening/closing a suction side and a discharge side of the compression space alternately so that the compression space of the cylinder is connected with the suction inlet and the discharge outlet alternately said discharge valve assembly and said suction valve assembly each directly facing a side portion of the compression space; and oil valves mounted on center portions of oil paths, which are formed on inner cross-sections of the cylinder, for controlling flow of the oil.

8. The apparatus of claim 7, wherein the oil paths are formed to be connected with the compression space of the cylinder by being opened to a suction path on sides of the cylinder.

9. An oil supplying apparatus for an opposed type reciprocating compressor comprising:

a casing having a suction inlet and a discharge outlet on sides thereof, said casing containing a predetermined amount of oil;

a plurality of reciprocating motors installed inside said casing to perform linear reciprocating movements toward opposite directions of each other;

a cylinder including a compression space between the reciprocating motors;

a plurality of pistons coupled to armatures of the reciprocating motors and inserted slidingly into the cylinder so that front end surfaces thereof face each other;

a discharge valve assembly and a suction valve assembly for opening/closing a suction side and a discharge side of the compression space alternately so that the compression space of the cylinder is connected with the suction inlet and the discharge outlet alternately; and oil valves mounted on center portions of oil paths, which are formed on inner cross-section of the cylinder, for controlling flow of the oil, wherein the oil paths include oil valve escape recesses which are slanted toward symmetric directions of each other, and thereby the oil valves are formed as free bodies for opening/closing the oil paths by reciprocating between the oil paths and the oil valve escape recesses according to the type of compressor installation.

10. The apparatus of claim 9, wherein oil guiding pipes for guiding the oil in the casing into the oil paths are mounted on starting ends of the oil paths.

11. The apparatus of claim 9, wherein the oil valves are formed as spheres.

12. The apparatus of claim 9, wherein a diameter of an oil valve escape recesses is the same as a diameter of the oil valves and is larger than a diameter of the oil paths.

13. An oil supplying apparatus for an opposed type reciprocating compressor comprising:

a casing having a suction inlet and a discharge outlet which are connectable with each other, said casing containing a predetermined amount of oil;

a plurality of reciprocating motors installed inside said casing to perform linear reciprocating movements toward opposite directions of each other;

a cylinder, including a suction path connecting with the suction inlet and a discharge path connecting with the discharge outlet, a compression space between the suction path and the discharge path, and an oil path connecting with the compression space;

a plurality of pistons coupled to armatures of the reciprocating motors and inserted slidingly as sliding into the cylinder so that front end surfaces of said pistons face each other across the compression space;

a discharge valve assembly and a suction valve assembly for opening/closing a suction side and a discharge side of the compression space alternately so that the compression space of the cylinder is connected with the suction inlet and the discharge outlet alternately;

spring supporting plates coupled to the armatures of the reciprocating motors;

oil kickers coupled to outer circumferential surfaces of the spring supporting plates for kicking the oil inside the casing during the reciprocating movements; and oil valves mounted on center portions of the oil paths, the oil valves being formed on an inner cross-section of the cylinder, for controlling flow of the oil.

14. The apparatus of claim 13, wherein the cylinder includes one or more oil holes for inducing and recalling oil collecting respectively on sides of a through-hole through which the pistons are inserted.

15. The apparatus of claim 13, wherein ends of the oil kickers coupled to the spring supporting plates are formed to be soaked in the oil inside the casing.

16. The apparatus of claim 15, wherein the oil kickers are formed as rings and mounted on ends of the spring supporting plates.

17. The apparatus of claim 13, wherein the oil paths are formed to connect with the compression space formed inside the cylinder by being connected with a suction path of the cylinder.

18. The apparatus of claim 13, wherein the oil paths include oil valve escape recesses which are slanted toward symmetric directions of each other, and thereby the oil valves are formed as free bodies for opening/closing the oil paths by reciprocating between the oil paths and the oil valve escape recesses according to the installation type of the compressor.

19. The apparatus of claim 18, wherein oil guiding pipes for guiding the oil in the casing into the oil paths are mounted on starting ends of the oil paths.

20. The apparatus of claim 18, wherein the oil valves are formed as spheres.

21. The apparatus of claim 18, wherein a diameter of an oil valve escape recesses is the same as a diameter of the oil valves and is larger a diameter of the oil paths.

* * * * *